United States Patent [19]

Sasaki et al.

[11] 4,406,772

[45] Sep. 27, 1983

[54] HYDROCONVERSION OF HEAVY HYDROCARBON OILS

[75] Inventors: Yoshiyuki Sasaki, Yatabe; Etsuro Nakamura, Ushiku; Yoshimoto Ojima, Nagareyama; Teruo Kondo, Tsuchiura; Koji Ukegawa, Sakura; Akimitsu Matsumura, Noda, all of Japan

[73] Assignee: Director-General of Agency of Industrial Science & Technology, Tokyo, Japan

[21] Appl. No.: 387,478

[22] Filed: Jun. 11, 1982

[30] Foreign Application Priority Data

Jun. 17, 1981 [JP] Japan ..... 56-93249

[51] Int. Cl.[3] ..... C10G 47/10; C10G 45/04

[52] U.S. Cl. ..... 208/112; 208/213; 208/251 H

[58] Field of Search ..... 208/112, 213, 251 H

[56] References Cited

U.S. PATENT DOCUMENTS

| | | | |
|---|---|---|---|
| 2,864,762 | 12/1958 | Lanning et al. | 208/112 |
| 3,617,481 | 11/1971 | Voorhies, Jr. et al. | 208/50 |
| 3,923,635 | 12/1975 | Schulman et al. | 208/50 |

*Primary Examiner*—Delbert E. Gantz
*Assistant Examiner*—O. Chaudhuri
*Attorney, Agent, or Firm*—Stephen F. K. Yee

[57] ABSTRACT

Heavy hydrocarbon oils such as vacuum residues are converted into light hydrocarbon oils by reaction with hydrogen in the presence of a catalyst. The catalyst is obtained as a by-product in the system and includes a coke produced by the hydrotreatment and metal components, such as vanadium and nickel, derived from the heavy hydrocarbon oils and deposited on the coke during the hydrotreatment. A portion of the reaction residue is subjected to a treatment to recover the metal components, a part of which are used in the catalyst.

5 Claims, 1 Drawing Figure

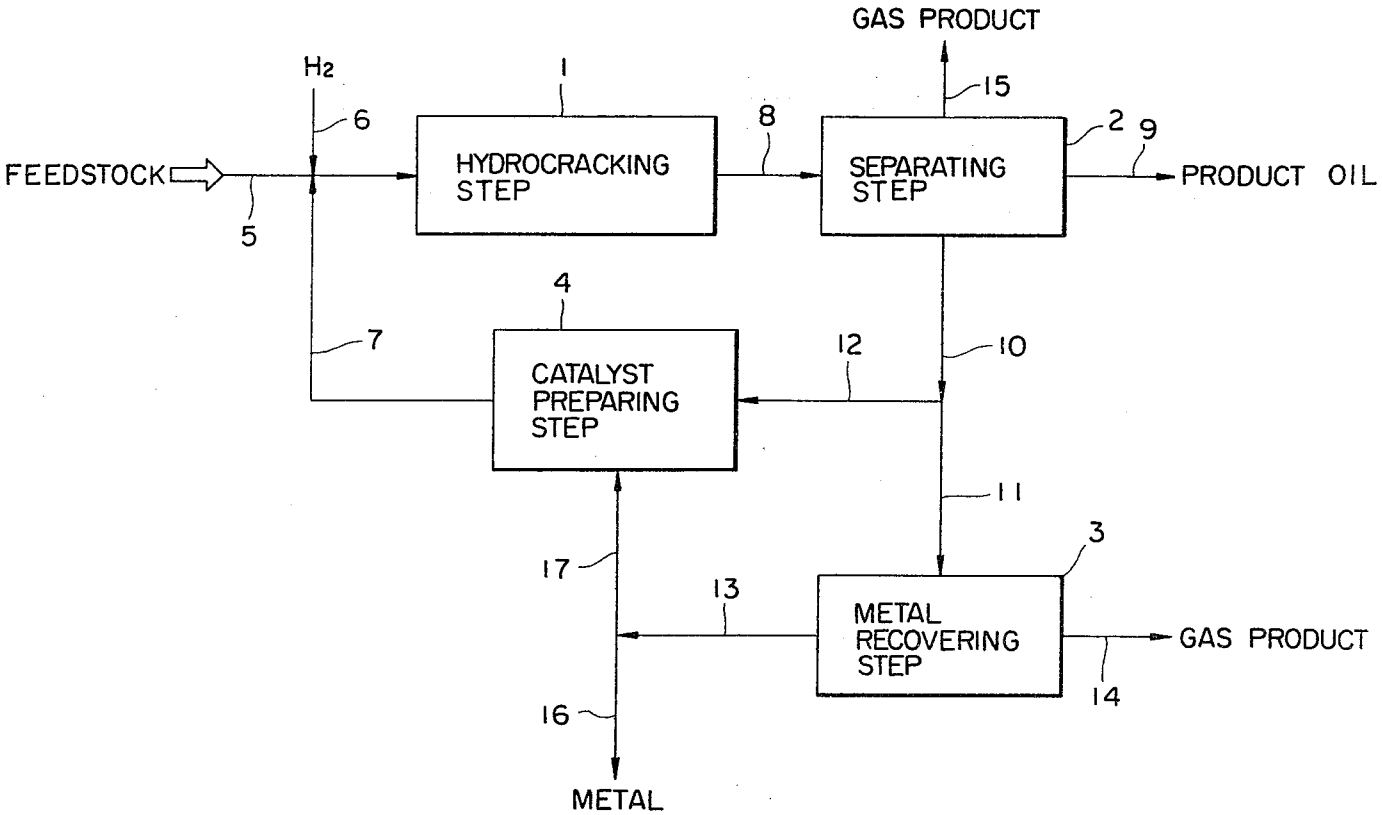
FEEDSTOCK
5
$H_2$
6
7
HYDROCRACKING STEP
1
8
SEPARATING STEP
2
9
PRODUCT OIL
15
GAS PRODUCT
4
CATALYST PREPARING STEP
12
10
11
METAL RECOVERING STEP
3
14
GAS PRODUCT
13
17
16
METAL

HYDROCONVERSION OF HEAVY HYDROCARBON OILS

BACKGROUND OF THE INVENTION

This invention relates to a process for the hydroconversion of heavy hydrocarbon oils, and more specifically to a process for hydrocracking heavy hydrocarbon oils in the presence of a catalyst.

A variety of processes have been hitherto proposed for catalytically converting, by reaction with hydrogen, heavy hydrocarbon oils containing significant amounts of extremely high molecular weight compounds, such as vacuum residues, into more valuable, light hydrocarbon oils. Such treatment generally employs one or more metals such as molybdenum, nickel and cobalt supported on a carrier such as alumina or silica as the catalyst. The reaction is generally carried out at a relatively high temperature so as to effect such hydrotreatment with practically acceptabe efficiency. At such a high reaction temperature, however, polycondensation of the high molecular weight compounds such as asphaltenes is accelerated, thereby forming a large amount of coke. The coke thus formed can deposit on the catalyst particles, causing the deterioration of the catalyst, clogging of the reactor and the like troubles. While an increase in the amount of hydrogen feed is effective to suppress the coke formation, such as increase in hydrogen consumption is not acceptable from the economic point of view.

SUMMARY OF THE INVENTION

The present invention provides an improved process for the hydroconversion of a heavy hydrocarbon oil, wherein the heavy hydrocarbon oil is reacted with hydrogen in the presence of a catalyst. The improvement involves the catalyst which is comprised of a coke produced in the hydrocracking step and metal components derived from the heavy hydrocarbon oil and deposited on the coke in the hydrocracking step.

In a preferred aspect, the present invention provides a process of the above-mentioned type, which includes the steps of: reacting a heavy hydrocarbon oil with hydrogen in the presence of a catalyst to obtain a hydrocracked product including a coke on which metals contained in the heavy hydrocarbon oil are deposited; separating the metal-containing coke from the hydrocracked product; treating a portion of the reaction residue and the metal-containing coke to recover the metal components therefrom; and recycling a mixture of a part of the recovered metal components and the thus-separated coke to the reacting step as the said catalyst.

It is, therefore, an object of the present invention to provide an economical process for catalytically hydrocracking heavy hydrocarbon oils.

Another object of the present invention is to provide a process of the above-mentioned type, in which by-products formed during the hydrocracking treatment are used as the catalyst.

BRIEF DESCRIPTION OF THE DRAWING

Other objects, features and advantages of the present invention will become apparent from the detailed description of the preferred embodiments of the invention which follows, when considered in light of the accompanying drawing in which:

the sole FIGURE is a flow diagram schematically showing one embodiment of the system for carrying out the process of this invention.

DETAILED DESCRIPTION OF THE PREFERRED EMBODIMENTS OF THE INVENTION

Referring generally to the FIGURE, a heavy hydrocarbon feedstock oil to be treated is fed via line 5 to a hydrocracking step 1 where it is subjected to hydrocracking conditions. Any heavy hydrocarbon oils may be used as the feedstock as long as they contain at least one heavy metals belonging to Groups VB and VIII of the Periodic Table, especially iron, vanadium and/or nickel, preferably in an amouont of 50 ppm or more. Illustrative of such oils are crude oils, reduced crude oils, shale oils, tar sand bitumen, liquified coal oils, vacuum distillation residues, pitches, deasphalted oils and mixtures thereof.

Introduced also into the hydrocracking step 1 through lines 6 and 7 are hydrogen and a catalyst, respectively. Thus, in the hydrocracking step, the feed oil is reacted with hydrogen in the presence of the catalyst and undergoes hydrocracking, desulfurization, demetallization and other reactions. The prominent feature of this invention resides in that a coke secondarily produced in the hydrocracking step and having metal components deposited thereon is used as the catalyst. In the hydrocracking step, the metal components in the feed oil deposit and accumulate on the coke. The coke having such metals deposited thereon has been found to exhibit a desirable hydroconversion activity and to be effective to suppress the occurrence of coking. In order for the catalyst to exhibit the desirable activity, it is preferred that the amount of the metal components in the catalyst be in the range of 1–60 wt %.

The hydrocracking conditions in the step 1 include a reaction temperature of 350–500° C., preferably 400–450° C., and a hydrogen pressure of 30–250 $Kg/cm^2$, preferably 100–200 $Kg/cm^2$. Although the reaction may be effected in a packed bed system, the use of an ebbulated bed or a slurry bed system is more preferable since with it the process may be operated continuously while maintaining the amount of the metals on the coke catalyst within a predetermined range.

In starting up the hydrocracking, it is recommended to add a suitable quantity of a nickel or vanadium compound to the feed oil so as to expedite the formation of the catalyst. Alternatively, it is possible to temporarily use active carbon having supported thereon nickel and/or vanadium as catalyst. In either case, since, as the hydrocracking proceeds, coke is formed with the metal components in the feed oil depositing and accumulating thereon and since the thus formed metal-carrying coke serves to act as catalyst, it is not necessary to supply, after start up, the nickel and/or vanadium compound or the active carbon catalyst to the hydrocracking step. Examples of the nickel and vanadium compounds include acetylacetonatonickel, nickel acetate, nickel carbonate, nickel formate, oxyacetylacetonatovanadium, vanadium oxyoxalate and vanadium alkoxides.

The hydrocracked product is discharged from the hydrocracking step 1 and is introduced via line 8 into a separating step 2 where it is separated into a gaseous product discharged through a line 15, a product oil recovered through a line 9 and a residue withdrawn through a line 10. The separation step may be constituted by, for example, centrifuge, distillation, solvent extraction, filtration or a combination thereof. Thus, the residue may be a solid or solids-rich phase containing the catalyst or a heavy fraction in the form of slurry containing the catalyst.

A portion of the residue discharged from the separating step 2 through the line 10 is introduced via line 11 into a metal recovering step 3 where it is subjected to a metal recovering treatment such as partial oxidation, combustion, steam reforming or oxidizing roasting, to recover its metal components. The metal components, which may contain fry ash or other solid matters formed in the metal recovering step 3 are discharged from the step 3 through a line 13, while the gas product from the step 3 is withdrawn through a line 14. The gas product, when it contains hydrogen, may be recycled to the hydrocracking step 1 as a part of the hydrogen fed through the line 6, if desired.

The other portion of the residue discharged through the line 10 is introduced via line 12 into a catalyst preparing step 4, where it is mixed with at least a portion of the metal components introduced from the metal recovering step 3 via lines 13 and 17. The metal components are, if necessary, washed with water or a diluted acid for the removal of sodium oxide, calcium oxide, etc., before it is fed to the step 4. The remaining portion of the metal components from the line 13 is discharged out of the system via line 16 for recovery. The amount of the metal components mixed with the residue from the line 12 is such that the metal content of the resulting mixture is about 1–60 wt % based on the weight of its solid contents. The term "metal content" used herein means the content of nickel, vanadium and iron in terms of elemental metal. The thus obtained mixture is then fed to the hydrocracking step 1 via line 7 for use as catalyst. It is preferred that the mixture be pulverized into a particle size of about 20–200$\mu$. The pulverization may be performed by any known means such as a ball mill.

The amount of the mixture fed to the hydrocracking step 1 is such that the amount of its coke content is 0.01–30 wt %, preferably 1–6 wt %, based on the weight of the feed oil in the hydrocracking step 1 and that the amount of its metal components is 0.001–20 wt %, preferably 0.1–3.6 wt %, based on the weight of the feed oil in the step 1. In this regard, the amount of metals herein includes that contained in the feed oil. The term "amount of coke" herein means the amount of carbonaceous materials which are insoluble in toluene extraction at 100.6° C. The term "amount of metals" means the total amount of vanadium, nickel and iron in terms of elemental metal.

The process of the present invention is very advantageous because the catalyst used in the hydrocracking step is a by-product of the system and is easily separable from the hydrocracked product. Further, it is easy to recover metals from the catalyst. The process of this invention has an additional merit in that the abrasion of the interior wall of the reactor by contact with the moving catalyst is minimized.

The following example will further illustrate the present invention.

EXAMPLE

In a 500 ml autoclave were charged 100 g of Gach Saran vacuum residues (vanadium content: 295 ppm, nickel content: 87 ppm, sulfur content: 3.48%, n-heptane insolubles: 9.1 g, specific gravity (15/4° C.):1.023), 16 g of acetylacetonatonickel and 80 atm of hydrogen, and the mixture was allowed to react at 440° C. for 1 hour. Thereafter, the reaction mixture was subjected to centrifuge to obtain a product oil and a coke-containing solid phase. After being separated from the product oil, the solid phase was washed with benzene and pulverized into particles of 170 mesh or finer. The yield of the coke-containing solid (coke catalyst) was 7 g. The properties of the coke catalyst were as shown in Table 1 in which the properties of the customarily employed $\gamma$-alumina and activated carbon were also shown for comparison purposes.

TABLE 1

| | Coke catalyst | $\gamma$-alumina | Activated carbon |
|---|---|---|---|
| Particle size (Tyler mesh) | 170 or finer | 200 or finer | 170 or finer |
| Specific surface area ($m^2/g$) | 17 | 163 | 1017 |
| Pore distribution (ml/g) | | | |
| 50–100 A | 0.001 or less | 0.087 | 0.035 |
| 100–200 A | 0.003 | 0.567 | 0.014 |
| 200–400 A | 0.009 | 0.167 | 0.010 |
| 400–600 A | 0.012 | 0.029 | 0.003 |
| 600–1000 A | 0.029 | 0.033 | 0.006 |
| Metal content | | | |
| Ni | 38.6 | 0 | 0 |
| V | 21.1 | 0 | 0 |

Hydrocracking of the Gach Saran vacuum residues was then carried out using the thus prepared coke catalyst. In a 500 ml autoclave was charged 3 g of the coke catalyst, 100 g of the vacuum residues and 100 atm of hydrogen. The mixture was allowed to react at 400° C. for 1 hour. The resulting reaction mixture was subjected to centrifuge to separate it into a liquid product and solids to examine their properties. The results are shown in Table 2. For comparison, tests were conducted using $\gamma$-alumina catalyst having supported thereon 7.7 wt % of cobalt and molybdenum (by weight ratio of cobalt to molybdenum being 1/2) and activated carbon catalyst having supported thereon 28.6 wt % of nickel and vanadium (by weight ratio of nickel to vanadium being 7/3), respectively in place of the coke catalyst of this invention. The results are also shown in Table 2. A further test was performed using no catalyst with the results that coking occurred considerably so that the reaction had to be stopped after 15 min. from the start of the hydrocracking.

It will be appreciated from Table 2 that the process of the present invention using a coke catalyst can produce, with a high yield, a product oil having a decreased viscosity, specific gravity, asphaltene content, sulfur content and metal content. Although the catalytic performance of the coke catalyst is somewhat lower than the conventional desulfurization catalyst, the coke catalyst has advantages in that the hydrogen consumption is low and deposition of carbonaceous matters on the catalyst is low. Thus, the process of the present invention is effective for the treatment of heavy hydrocarbon oils for desulfurization, demetallization, decomposition of asphaltenes and conversion into light hydrocarbon oil.

TABLE 2

| | Coke catalyst | $\gamma$-Alumina catalyst | Activated carbon catalyst |
|---|---|---|---|
| Product Oil | | | |
| Yield | 92.1 | 91.2 | 90.4 |
| n-Heptane insolubles | | | |

TABLE 2-continued

| | Coke catalyst | γ-Alumina catalyst | Activated carbon catalyst |
|---|---|---|---|
| (g) | 4.4 | 3.3 | 3.9 |
| Viscosity (cst) | 20.4 | 15.4 | 14.0 |
| Specific gravity (15/4° C.) | 0.938 | 0.921 | 0.930 |
| Sulfur content (wt %) | 2.18 | 1.20 | 1.81 |
| Vanadium content (ppm) | 36 | 11 | 40 |
| Nickel content (ppm) | 38 | 16 | 21 |
| Amount of gaseous hydrocarbon | 3.4 | 4.1 | 4.5 |
| Amount of n-heptane-insoluble carbonaceous matters (g) | 2.2 | 1.9 | 2.8 |
| Hydrogen consumption | 1.30 | 1.69 | 1.44 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embranced therein.

We claim:

1. A process for the hydroconversion of a heavy hydrocarbon oil, comprising the steps of:

reacting the heavy hydrocarbon oil with hydrogen in the presence of a catalyst to obtain a hydrocracked product including a coke on which are deposited metals contained in the heavy hydrocarbon oil and coke-forming components;

separating gaeous and liquid products from the hydrocracked product, leaving a residue containing said metals-containing coke;

dividing said residue into a first portion and a second portion;

subjecting said second residue portion to a metal recovery treatment to recover metal components;

mixing at least a part of said recovered metal components with said first residue portion;

pulverizing said mixture so that the solids matters in said mixture have particle sizes in the range of 20–200μ; and recycling said pulverized mixture to said reacting step as said catalyst.

2. A process as set forth in claim 1, wherein the metal components are mixed with said first portion in an amount so that the total content of vanadium, iron and nickel of the resulting mixture is about 1–60 wt %, in terms of elemental metal, based on the weight of the solids content of said mixture.

3. A process as set forth in claim 1, wherein the reaction step is performed at a temperature of about 350°–500° C. and a hydrogen pressure of about 30–250 $kg/cm^2$.

4. a process as set forth in claim 1, wherein the separation is by distillation, filtration, solvent extraction, centrifuge or a combination thereof.

5. A process as set forth in claim 1, wherein the recovery is by partial oxidation, combustion, steam reforming or oxidizing roasting.

* * * * *